United States Patent [19]

Kirby

[11] Patent Number: 4,559,527

[45] Date of Patent: Dec. 17, 1985

[54] DUAL MODE ELECTRONIC INTRUSION OR BURGLAR ALARM SYSTEM

[76] Inventor: Brian T. Kirby, 6434 Betsy Ross Pl., Wauwatosa, Wis. 53213

[21] Appl. No.: 428,392

[22] Filed: Sep. 29, 1982

[51] Int. Cl.[4] ..... G08B 13/08

[52] U.S. Cl. ..... 340/545; 340/528

[58] Field of Search ..... 340/501, 528, 541, 545

[56] References Cited

U.S. PATENT DOCUMENTS 3,662,372 5/1972 Levy ..... 340/545 X
3,866,201 2/1975 Beiswenger ..... 340/528

FOREIGN PATENT DOCUMENTS 0015656 9/1980 European Pat. Off. ..... 340/541
2910594 9/1980 Fed. Rep. of Germany ..... 340/545

*Primary Examiner*—James L. Rowland
*Assistant Examiner*—Brian R. Tumm

[57] ABSTRACT

A dual mode electronic intrusion or burglar alarm system for use with a door or window which can be opened and closed comprises a switch actuatable by the door or window, a control circuit, including time delay circuitry, operatively connected to the switch and responsive to switch actuation to operate in either of two modes, and an alarm connected to be operated by the control circuit. When the system is in operation and armed in a first mode, initial actuation of the switch in response to opening of the door or window causes the control circuit to actuate the alarm for a first predetermined interval of time, then to shut off the alarm and arm itself in a second mode wherein subsequent actuation of the switch in response to closing of the door or window causes the control circuit to again actuate the alarm for a second predetermined interval of time. The system can be reset for operation in the first mode either during the first interval of time, or at any time thereafter, i.e., during the time it is armed in the second mode, or during the second interval of time. The system aims to trap, or at least further discourage, an intruder who observes or counts on the fact that the first actuation of the alarm fails to evoke an appropriate security response and returns to complete the intrusion and closes the door or window after entry to provide the appearance of normality.

1 Claim, 8 Drawing Figures

DUAL MODE ELECTRONIC INTRUSION OR BURGLAR ALARM SYSTEM

BACKGROUND OF THE INVENTION

1. Field of Use

This invention relates generally to electric or electronic intrusion or burglar alarm systems, and particularly to systems wherein actuation of a switch by opening a door or window to gain access therethrough causes actuation of an alarm for an interval of time.

2. Description of the Prior Art

Some prior art electric or electronic intrusion or burglar alarm systems are designed to warn of and discourage attempts by an unauthorized person to enter a structure, such as a building or vehicle, by opening a door or window to gain access therethrough. Such prior art systems typically comprise a switch actuatable by the door or window (hereinafter simply referred to as "door"), a control circuit operatively connected to the switch and responsive to switch actuation, and an alarm, such as a bell or siren, connected to be operated by the control system. In operation, opening of the door actuates the switch thereby causing the control system to operate the alarm with the two-fold object of summoning a responsible person, such as a householder or guard, and of frightening the intruder away. Some control systems operate the alarm until appropriate personnel are summoned and operate a shutoff switch, whereas other control systems embody means to shut off the alarm automatically after an appropriate interval of time, usually several minutes. The following U.S. Patents illustrate the state of the art: U.S. Pat. Nos. 4,188,621, 4,174,516, 4,164,736, 4,156,235, 4,137,526, 4,074,248 and 3,626,403.

In some cases, an intruder knowledgeable in the operation of prior art intrusion or burglar alarm systems, will postpone entry through the open door until the alarm automatically shuts off and, if no responsible person has appeared by then, will enter the structure, closing the door after himself to create the appearance of normality. The possibility of a responsible person failing to respond to the alarm is increased in remote localities where few people are about or, sometimes, in localities where high background noise occasionally overcomes or obscures the sound of the alarm.

SUMMARY OF THE INVENTION

A dual mode electronic intrusion or burglar alarm system in accordance with the invention for use with a door or window which can be opened and closed comprises a switch actuatable by the door or window, a control circuit operatively connected to the switch and responsive to switch actuation to operate in either of two modes, and an alarm connected to be operated by the control circuit. When the system is in operation and armed in a first mode, initial actuation of the switch in response to opening of the door or window causes the control circuit to actuate the alarm for a first predetermined interval of time, then to shut off the alarm and arm itself in a second mode wherein subsequent actuation of the switch in response to closing of the door or window causes the control circuit to again actuate the alarm for a second predetermined interval of time. The system can be reset for operation in the first mode either during the first interval of time or during the time it is armed in the second mode, or during the second interval of time. The system aims to trap, or at least further discourage, an intruder who observes or counts on the fact that the first actuation of the alarm fails to evoke an appropriate security response and returns to complete the intrusion and closes the door or window after entry to provide the appearance of normality.

In a preferred embodiment of the system a plurality of switches are provided, each actuatable by a door or window, and one of the door actuated switches serves as a delay switch which is connected to a delay circuit in the control circuit to enable the householder, or person in charge of the premises and the alarm system to enter or leave the premises (thereby opening or closing a switch) during a short interval of time before the alarm sounds after having initally actuated a switch to arm the system or while entering to actuate a switch to disarm the system.

Some advantages of the dual mode system in accordance with the invention are as follows.

The homeowner can set the system while doors and/or windows are open and thus entrap an intruder.

Returning intruders are fooled into thinking system is inactive, and may re-enter and close door behind them, causing another alarm.

The system automatically adjusts to present conditions allowing windows to be left open at night for air, but still protecting rest of house.

The system can use sensor transducers of either normally open or normally closed design. No special wiring is needed. The system automatically adapts to whatever type is used.

Use of opto-coupled loops prevents false triggering by RF noise associated with long wiring in noising environments i.e., not electrically connected.

Other objects and advantages of the invention will hereinafter appear.

DRAWINGS

DESCRIPTION OF PREFERRED EMBODIMENT

Figure 1:
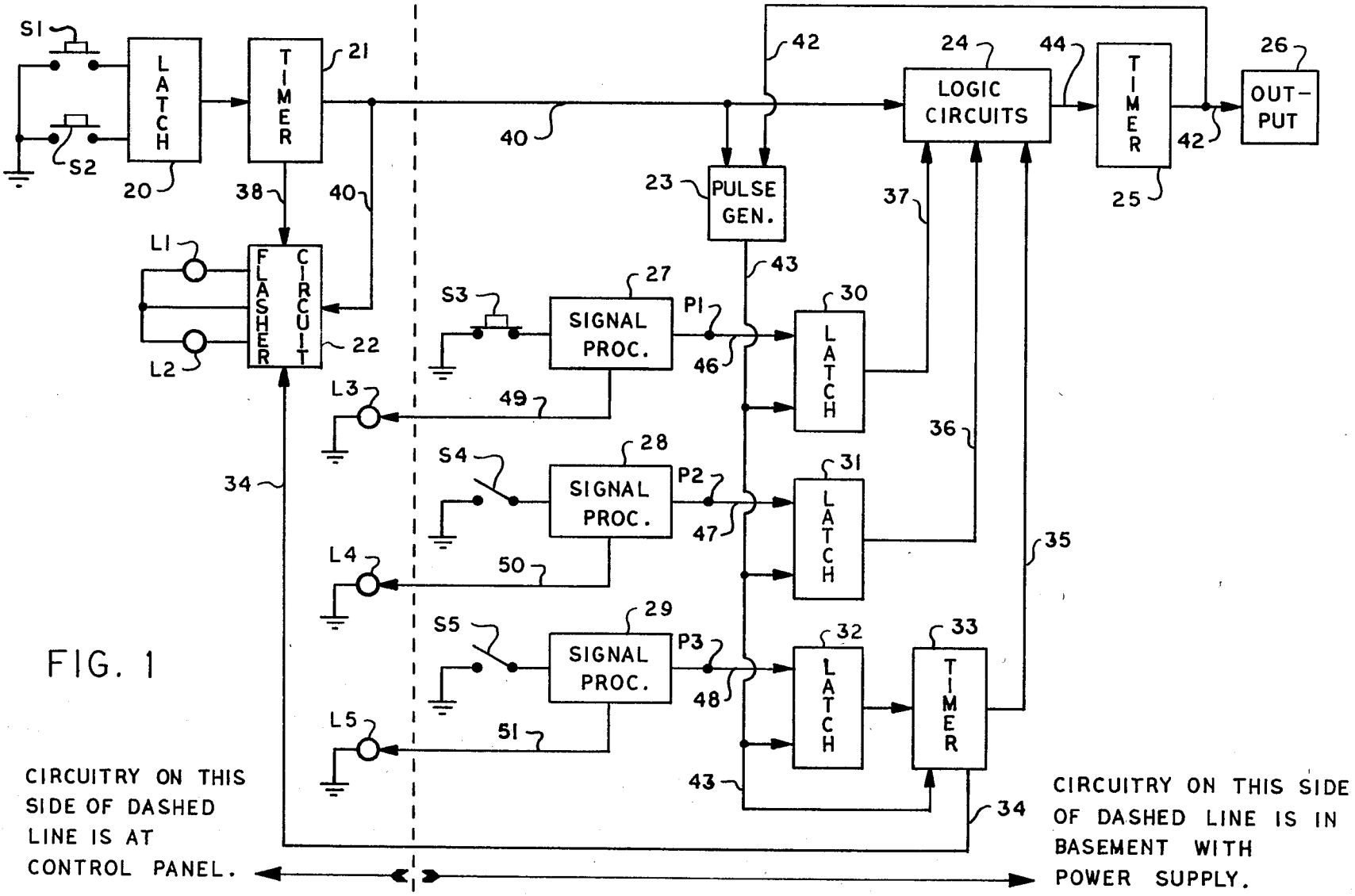
FIG. 1 is a schemataic diagram of a dual mode electronic intrusion or burglar alarm system in accordance with the invention.

Referring to FIG. 1, the alarm system generally comprises six basic sections or subcircuits, namely:

(1) ARM/DISARM LATCH CIRCUIT 20;
(2) ARM TIMER 21;
(3) ENABLE GATES 24;
(4) SENSOR CIRCUITS 29 and 28 (timed and instant, respectively) and TAMPER CIRCUIT 27;
(5) ALARM OR SIREN TIMER 25;
(6) OUTPUT DEVICE (alarm) 26.

Operation of the installed system of FIG. 1 is generally as follows. The operator (hereinafter called "homeowner") presses an "arm" switch S1 causing arming latch 20 to lock in a timing circuit 21. The homeowner has a set time to vacate the premises before the system actually arms itself. When the arm timer 21 runs out, it simultaneously resets the sensor circuits 27, 28, 29 and enables the logic gates 24. One of two possibilities of causing an actual "alarm" then exists, namely, either opening a closed circuit, or closing an open circuit. The mode of operation is dependent upon the condition of the loop(s) S3, S4, S5 at the time the arm timer 21 resets the sensor circuits 27, 28, 29. Since there may be several sensor circuits or loops 27, 28, 29, it is possible for some to be open and some to be closed. However, it will be assumed for purposes of the present discussion that they are all closed loops. It is also understood that the door(s) loop S5 is a timed delay loop 33 that enables the homeowner to enter the house and disarm the system within a set time. Failure to disarm the system in time will cause an alarm condition. If an intruder enters the house by opening the door, he will be unlikely to be able to disarm the system because of a hidden disarming switch S2 or optional key/decoder system (not shown).

When the alarm condition is activated the following takes place. Sensor circuitry latches 30, 31, 32 and cannot be unlatched by intruder. Instant loop 28 starts the siren timer 25 immediately when violated. Delay loop 29 starts the siren timer 25 after a brief delay. Siren timer 25 immediately sounds the siren and speaker system 26 and continues for a predetermined time. When the siren timer 25 runs out, it stops the siren 26 and sends a reset pulse to the sensor circuit latches 30, 31, 32. Sensor circuits 30, 31, 32 are reset as if the circuit had been just armed, i.e., open circuits trigger when closed and closed circuits trigger when opened. Operation then is identical to what has already been described.

Figure 2:
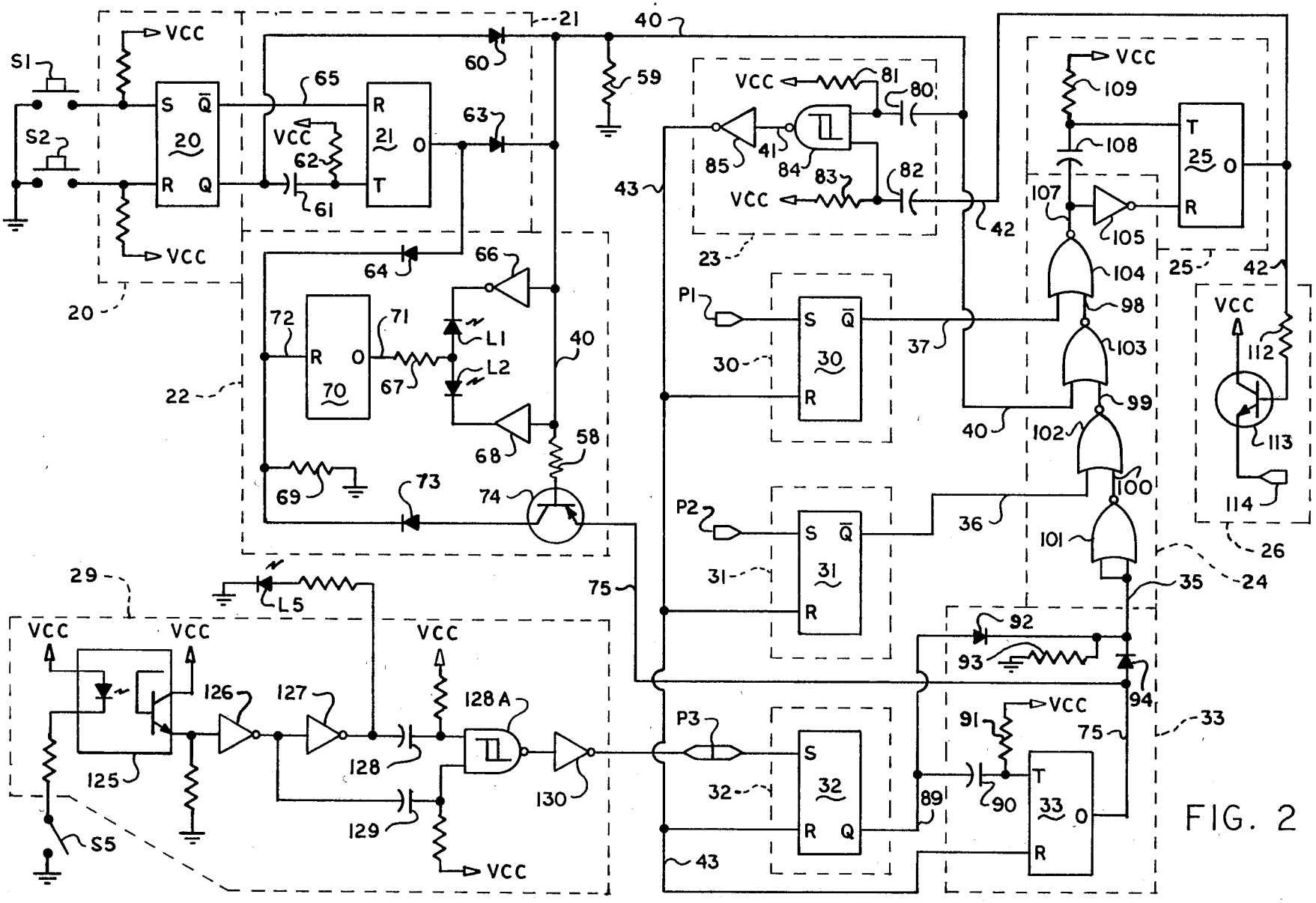
FIG. 2 is an electric circuit diagram of the system shown schematically in FIG. 1.

Referring now to FIGS. 1 and 2, the electronic intrusion alarm system comprises the following. An arming switch S1 to arm the system. A disarming switch S2 to disarm the system. A latch 20 to hold the system in the condition selected by S1 or S2. A time delay means 21 to allow the user to "arm" the system and exit the premises before the system actually arms the timer 21 is not used when disarming the system. A flasher circuit 22 to provide visual indication of the status of the system, as well as to provide indication of timing functions.

Three different loops are provided.

The loop including switch S3 is the tamper loop and will cause an instant alarm any time it is disturbed whether the system is armed or disarmed.

The loop including switch S4 is the instant loop and will cause an instant alarm when disturbed only when the system is armed.

The system is armed by the pressing of arm switch S1 and the system is disarmed by pressing disarm switch S2. S1 and S2 control a latch 20, that enables or disables a timer 21. When S1 is pressed, latch 20 enables timer 21. Timer 21 keeps line 40 high for a predetermined time. When timer 21 runs out, line 40 goes low. The system is now armed. When disarming the system, S2 is pressed which resets latch 20 and drives line 40 high, the timer is not used when disarm is pressed because latch 20 disables timer 21. Line 40 is the enable line to the logic circuits 24. When line 40 is low, the logic circuits 24 are said to be enabled. This means that signals present on lines 35 and 36 will cause an output at line 44. When line 40 is high, the logic circuits 24 are disabled. This means no output is possible unless line 37 goes high. Lines 35, and 36 do not affect the output line 44.

The loop containing switch S5 is the delay loop. It is enabled only when armed. When disturbed, the delay loop causes a timer 33 to provide a time delay before causing an alarm. Latches 30, 31 and 32 are provided to prevent deactivation of the alarm merely by reclosing switches S3, S4, and S5, respectively, after initially opening any of them.

Signal processors 27, 28 and 29 are provided to perform the four functions described below:

(1) To isolate the circuitry from RD noise picked up by the long wires that are used to connect S3, S4 and S5, respectively.

(2) To provide a short pulse which sets the latches 30, 31, and 32, respectively.

(3) To cause said pulse the instant S3, S4 and S5, respectively, are opened or closed. This feature allows the loops to be used in the normally open or normally closed mode.

(4) To provide a status light L3, L4 and L5, respectively, with current whenever S3, S4 and S5, respectively, are closed. Example: L4 on=S4 closed.

A pulse generator 23 is provided for sending a reset pulse to the latches 30, 31 and 32 and also to the delay timer 33. The reset pulse on line 43 is used to reset all inputs into the logic circuit 24 to the non-alarm state. The reset pulse occurs when the arm timer 21 runs out and when the alarm timer 25 runs out. Logic circuits 24 are used to "or" together the input lines 35, 36 and 37. Logic circuit 24 is provided with an enable line 40 to distinguish between an armed and disarmed condition. Logic circuit 24 has an output line 44 to signal a timer 25.

Timer 25 is used to provide a timed alarm signal to output 26 via line 42. The alarm signal lasts as long as timer 25 is on. When timer 25 runs out, the alarm stops and pulse generator 23 resets the system.

Output 26 is used to actuate relays, sirens, dialers and other accessories not shown.

It is to be understood that switches S1 and S2 could be replaced by a digital decoder and corresponding pushbutton keypad to allow only those who know a code number to use the alarm system. For the purpose of simplicity, two simple pushbutton switches S1 and S2 have been substituted.

Latch 20 is an R-S latch comprised of two cross coupled nand gates 56, 57 such as those found on a Motorola MC14011B Quad nand gate chip. An R-S latch is shown in detail in FIG. 3, but will be shown elsewhere as depicted in FIG. 4. Referring to FIG. 2, when arm switch S1 is closed momentarily, the output $\overline{Q}$ of latch 20 will become a "logical 1" or "high" as it will be referred to from now on. At the same instant, the Q output of latch 20 will become a "logical 0" or "low" as it will be referred to from now on. Pressing S2 momentarily, will reverse the outputs of latch 20, so that the $\overline{Q}$ output becomes low and the Q output goes high. The output Q of latch 20 is connected to enable line 40 through diode 60. Output Q is also capacitively coupled to the trigger input "T" of arm timer 21 through capacitor 61. Resistor 62 pulls the input "T" of timer 21 to a high level during standby conditions. Timer 21 is depicted as in FIG. 6 but more specifically is shown in FIG. 5.

Timer 21 is comprised of an integrated circuit. Specifically a Signetics NE555 or ½ of a Signetics NE556. Specific pin connections are shown in FIG. 5 to yield an adjustable Monostable timer. Typical time for the output of timer 21 would be one minute. The output of timer 21 is connected to enable line 40 through a diode 63. The output is also connected to flasher circuit 22 through a diode 64.

Operation of the arm/disarm sequence is as follows. Assuming the system to be disarmed, line 40 is at a high state. When S1 is pressed to arm the system latch 20 turns off current through diode 60, and instantly sends a negative pulse to trigger of timer 21. Timer 21 keeps line 40 high for about a minute through diode 63. After timer 21 runs out line 40 goes low. The logic gates 24 are now enabled and the system is armed. Disarming the system is accomplished by resetting latch 20. Pressing S2 resets the latch 20 and drives line 40 high. The timer 21 is kept from operating by disabling its reset input line 65. A flasher circuit 22 is provided to control two light emitting diodes (LED) L1 and L2. L1 is the disarmed LED because it glows when the system is disarmed. L2 is the armed LED and glows when the system is armed.

The flasher circuit 22 includes an inverting buffer 66, non-inverting buffer 68, current limiting resistors 58, 67, two diodes 64, and 73, astable multivibrator 70, resistor 69 and transistor 74. The flasher circuit 22 flashed L1 when timer 21 is in the timing mode indicating there is limited time to exit before the system arms. When the system is disarmed and line 40 is high, L1 glows continuously. The moment S1 is pressed, timer 21 enables the monostable multivibrator and current is pulsed through line 71, resistor 67 and LED L1. After the timer 21 runs out and the system is armed, line 40 goes low. This causes a high output from inverter 66 which reverse biases L1, causing no light to emit from L. At the same instant, L2 begins to glow steady, because a low is present at the output of buffer 68, indicating an armed condition. Multivibrator 70 is disabled because line 72 is held low by resistor 69, and no voltage is being supplied through either diode 64 or diode 73. When disabled, and using resistor 69, multivibrator 70 puts out a steady voltage on line 71 only when a resistor 69 is used as shown. L2 will flash only when line 40 is low, transistor 74 is turn on, and line 75 is high. This condition occurs when the system is armed and timer 33 is in the timing mode. L2 flashing means there is limited time to disarm before the alarm sounds. When line 40 goes low a negative pulse is supplied from the pulse generator 23 to reset all the sensor latches 30, 31 and 32, as well as the delay timer 33. This pulse is necessary to clear all inputs 35, 36, 37 from the logic circuits 24 when first arming.

The pulse generator is comprised of two coupling capacitors 80, 82, two pullup resistors 81, 83, one two input NAND SCHMITT TRIGGER GATE 84 and an inverting buffer 85. A positive rectangular pulse occurs at the output of gate 84 on line 41 whenever either input line 40 or 42 drops to a low state. Schmitt trigger 84 is typically ¼ of a Motorola MC14093 Quad two input NAND SCHMITT TRIGGER. It is used here to restore sharp digital signals. Inverter 85 turns the positive pulse on line 41 into a usable negative pulse on reset line 43. Resetting of the latches 30, 31 and 32 and timer 33 occurs when the system is armed and/or when the alarm timer 25 runs out. Reset line 43 is normally high.

Figure 3:
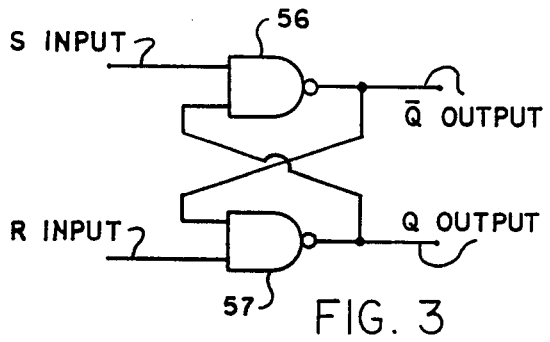
FIGS. 3, 4, 5, 6, 7 and 8 are portions of the circuit shown in FIG. 2.
Figure 4:
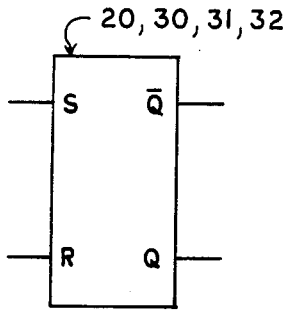
Figure 5:
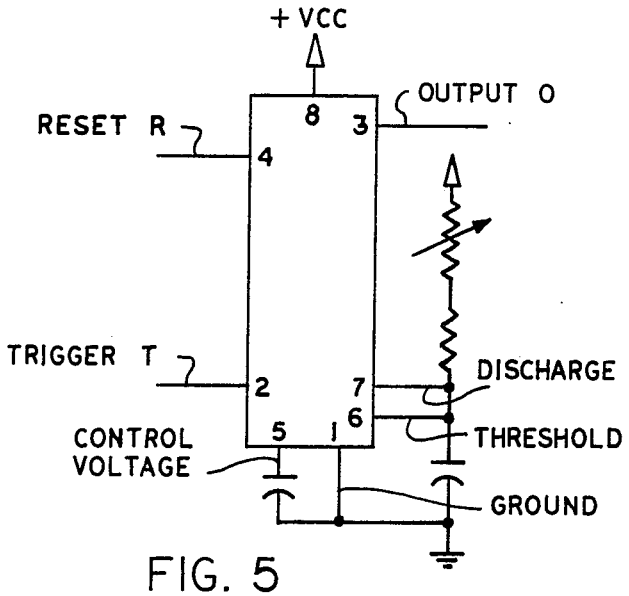

Latches 30, 31 and 32 are all R-S type shown as in FIG. 4 but specifically as in FIG. 3. Tamper latch 30 has its $\overline{Q}$ output connected to the logic circuit 24 via line 37. Instant loop latch 31 also has its $\overline{Q}$ output connected to the logic circuit 24 via line 36. Delay loop latch 32 also has its Q output 89 connected via a capacitor 90 to delay timer 33. Latch output 89 is also connected to line 35 via diode 92.

Timer 33 is a monostable timer such as that shown in FIG. 5. Its reset input is connected to reset line 43 and is normally enabled. Output line 75 of delay timer 33 is connected via diode 94 to line 35 of the logic circuits 24. Output line 75 is also connected to the emitter of transistor 74 and provides flasher 22 with a flash signal when system is armed and timer 33 is timing. Typical time for timer 33 is about 30 seconds. This allows the user to re-enter the secured area and disarm the system before an alarm condition is sensed by the logic circuit 24. Resistor 91 is a pullup resistor for the trigger of timer 33. Resistor 92 is a pulldown resistor for input line 35 to the logic circuits 24.

Logic circuits 24 consists of four two-input NOR GATES 101, 102, 103, and 104, and also inverter 105. Gates 101, 102, 103 and 104 are typically found on one I.C. chip specifically a Motorola MC14001B.

Gate 101 is wired as an inverter, and takes the signal on line 35 from the delay timer 33 and inverts it on output line 100.

Gate 102 is a NOR gate, and its output 99 will go low whenever either input line 36 or 100 goes high. Lines 36 and 100 go high when their respective latches 31 and 32, and timer 33, signal that there is a violation of the loop switches S4 and S5, respectively.

Gate 103 is a NOR gate with an enable line 40 and signal line 99 from gate 102. When enable line 40 is high, output 98 of gate 103 will always be low, regardless of the signal on input line 99. When the system is armed, and enable line 40 is low, gate 103 output 98 will remain low until input 99 goes low indicating an alarm condition. When this happens, line 98 is driven high.

Gate 104 output 107 goes low to trigger timer 25 through capacitor 108 whenever either of its inputs 37 or 98 goes high. Inverter 105 enables timer 25. Tamper latch 30 can cause an alarm even if the system is not armed.

Figure 6:
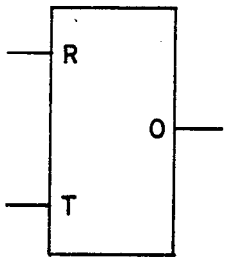
Figure 7:
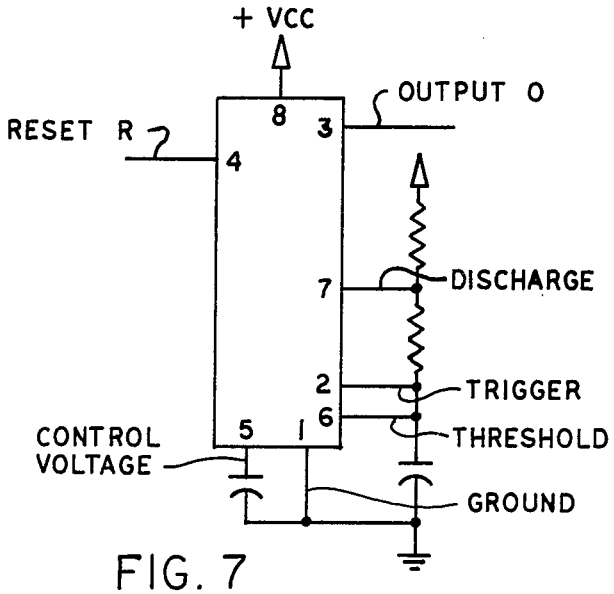
Figure 8:
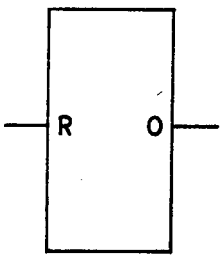

Alarm timer 25 is a monostable timer depicted as in FIG. 6. More specifically it is made from a Signetics NE 555 shown in detail in FIG. 5. It has an adjustable timer but would typically operate the output 26 for 15 minutes or so. Timer 25 output line 42 is connected to an output stage 26 and pulse generator 23 input. When timer 25 shuts off pulse generator 23 resets the system latches and the system is standing by in the armed state. Output 26 consists of a bias resistor 112 allowing transistor 113 to conduct current whenever the timer 25 is on. Connection point 114 is provided for operating sirens, relays, dialers and other accessories peculiar to the needs of the user.

Signal processor 29 is shown in detail in FIG. 2. It is understood that an identical circuit of that shown in FIG. 2 is connected at points P1 and P2 also. Signal processor 29 consists of an optically coupled transistor package 125, two inverting buffers 126, 127 two capacitors 128, 129, a two input nand Schmitt trigger 128A and inverting buffer 130. Operation is as follows:

Whenever S5 is opened, transistor 125 stops conducting. Inverter 126 output goes high and inverter 127 output goes low causing capacitor 128 to deliver a negative pulse to the input of SCHMITT Trigger 128A. A positive rectangular pulse enters inverter 130 and is turned to a negative pulse at point P3. This causes latch 32 to change states. Ultimately resulting in an alarm unless disarmed. Operation is similar when the S5 is closed. But in this case capacitor 129 delivers the negative pulse.

I claim:

1. In an intrusion alarm system for discouraging an intruder who observes that a first actuation for a limited time of an alarm occasioned by a first attempt at entry into secured premises fails to evoke an appropriate security response and then makes a second attempt at entry, in combination:

a plurality of components movable between open and closed positions and enabling entry into said secured premises when in open position;

a plurality of first switch means, each actuatable by movement of one of said components and having conditions corresponding to the positions of the component with which it is associated;

alarm means actuatable to provide a warning signal indicative of movement of any one of said components and observable by an intruder;

and control means, including timer means operatively connected to said plurality of said first switch means and to said alarm means and operable when any one of said first switch means is actuated from one condition to another condition to actuate said alarm for a first predetermined interval of time normally sufficient to evoke a security response, and further operable after termination of said first predetermined interval of time to again actuate said alarm for a second predetermined interval of time when said one of said first switch means is actuated from said other condition to said one condition, said control means further including:

second switch means selectively actuatable by a non-intruder to arm said system and enable it to operate said alarm and to disarm said system and prevent it from operating said alarm;

first time delay means responsive to arming actuation of said second switch means to provide a first time delay interval during which actuation of at least a selected one of said first switch means is ineffective to cause actuation of said alarm to thereby enable a non-intruder to exit the premises after arming said system;

and second time delay means actuatable at least by said selected one of said first switch means to provide a second time delay interval after said system is armed during which said selected one of said first switch means is ineffective to cause actuation of said alarm until lapse of said second time delay interval to thereby enable a non-intruder to enter the premises and disarm said system.

* * * * *